United States Patent [19]

Brownstein

[11] Patent Number: 4,837,586

[45] Date of Patent: Jun. 6, 1989

[54] IMAGE CONTRAST BY THERMAL PRINTERS

[75] Inventor: Scott A. Brownstein, Rochester, N.Y.

[73] Assignee: Eastman Kodak Company, Rochester, N.Y.

[21] Appl. No.: 149,253

[22] Filed: Jan. 28, 1988

[51] Int. Cl.[4] ..... B41S 3/20

[52] U.S. Cl. ..... 346/76 PH; 219/216

[58] Field of Search ..... 219/216 PH, 543; 346/76 PH; 400/120

[56] References Cited

U.S. PATENT DOCUMENTS

| | | | |
|---|---|---|---|
| 3,609,294 | 9/1971 | Cady | 219/216 PH |
| 3,903,393 | 9/1975 | Stapleton | 219/216 PH |
| 4,157,327 | 6/1979 | Martin et al. | 260/42.27 |
| 4,509,990 | 4/1985 | Vasudev | 357/49 |
| 4,607,277 | 8/1986 | Hasson et al. | 357/81 |

*Primary Examiner*—Teresa J. Walberg

*Attorney, Agent, or Firm*—Raymond L. Owens

[57] ABSTRACT

A thermal paste or other thermal resistance material is placed between the ceramic substrate and heat sink of a thermal print head. By selecting the thermal resistance of the material to be sufficiently low, print contrast is improved.

1 Claim, 3 Drawing Sheets

IMAGE CONTRAST BY THERMAL PRINTERS

FIELD OF THE INVENTION

The present invention relates to improving image contrast in continuous tone thermal printers.

BACKGROUND OF THE INVENTION

In a typical thermal printer, a web-type dye-carrier containing a series of spaced frames of different colored heat transferable dyes is spooled on a carrier supply spool. The carrier is paid out from the supply spool and rewound on a take up spool. The carrier moves through a nip formed between a thermal print head having heaters and a dye-absorbing receiver sheet. The receiver sheet is clamped to a rotatable drum. The receiver sheet may, for example, be coated paper and the print head is formed of a plurality of heating elements. When heat is supplied to the dye-carrier by heaters built into a thermal print head, dye is transferred to the receiver sheet.

The density, or darkness, of the printed dye is a function of the temperature of the heater and the time the carrier is heated, in other words the energy delivered from the heater to the carrier.

Thermal dye transfer printers offer the advantage of true "continuous tone" dye density transfer. This result is obtained by varying the energy applied to each heater, yielding a variable dye density image pixel on the receiver.

Digital image processing of the electrical signals is often used to improve the contrast of continuous tone prints.

A typical print head includes a ceramic substrate which is secured to a heat sink often made of aluminum.

Most manufacturers attach the ceramic directly to the aluminum heat sink. Since the aluminum and ceramic are not optically polished surfaces, the two surfaces will tend to have a large amount of void space. The void space is filled with air which acts as an insulator. The air filled void space makes the thermal resistance between the ceramic and the aluminum rather high. The high thermal resistance between the ceramic and aluminum causes localized heat build-up in the ceramic, resulting in a contrast loss in the printed image.

Some print head manufacturers use a thin strip of compliant material between the ceramic and the aluminum heat sink. This material is used in the electronics industry to provide better thermal conductivity between two surfaces (typically a power semiconductor and a heat sink). There are many types of material available, one type being polyimide plastic tape.

The purpose of the heat sink has been to solve the problem of excessive heat. Without proper heat dissipation, excessive temperatures can cause dimensional variations and effect the operation of electrical components. More specifically, the extreme temperatures produced during printing can damage the heaters and/or the shift register/driver integrated circuits mounted on the print head. If the thermal resistance between the ceramic and the aluminum were too low, there would be a significant reduction in printing efficiency.

Although the polyimide provides better thermal conductivity between the ceramic and the heat sink when compared to a bare joint, the polyimide does exhibit some thermal resistance.

Print heads utilizing polyimide exhibit a warm-up phenomena at the leading edge of a print. As the average temperature of the ceramic increases, the amount of dye transferred for a fixed electrical input increases. Effectively, this produces a density "ramp" in the dye transferred as the print head moves across the media. Conventional solutions to this problem include prewarming the print head before beginning the actual image transfer or modifying the data to correct for the initial lower ceramic temperature. A thermistor mounted in the head provides a means to sense the average temperature of the ceramic.

SUMMARY OF THE INVENTION

The object of this invention is to provide a thermal printer which can produce continuous tone prints with improved contrast and which minimize print head problems discussed above.

Decreasing the thermal resistance between the ceramic and the heat sink is actually beneficial and improves contrast and minimizes print head problems.

The object of this invention is achieved for use in a continuous tone thermal printer which has a print head having a ceramic substrate having first and second surfaces, heaters being provided on the first surface and a heat sink, means for fixedly mounting the heat sink to the second surface of the ceramic substrate comprising a thermal paste or other material with a low thermal resistance of less than about 0.6° C./Watt which causes the contrast of a thermal print produced by this head to be improved.

MODES OF CARRYING OUT THE INVENTION

Figure 1:
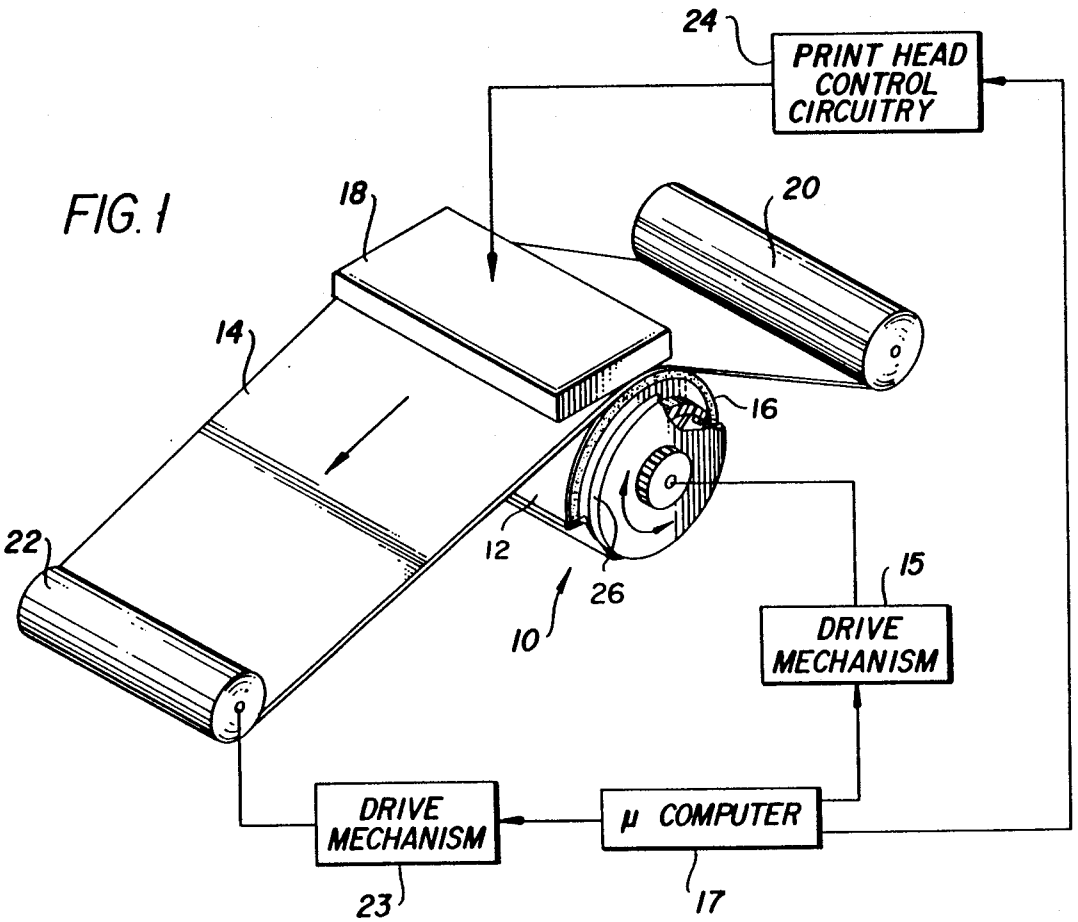
FIG. 1 is a schematic of a thermal printer apparatus which can be employed in accordance with the invention.

Turning first to FIG. 1 where there is shown a thermal printing apparatus 10 which uses a dye-carrier 14 and a receiver sheet 12. The receiver sheet 12 is clamped to a rotatable drum 16 which is mechanically coupled to a drive mechanism 15. It will be understood that the drive mechanism 15 can advance the drum in either clockwise or counterclockwise directions. When the drum 16 is being advanced in a counterclockwise direction, dye from the carrier 14 is transferred into the receiver sheet 12 at a nip position. A microcomputer 17 controls the operation of mechanism 15. Thermal print head 18 presses the dye-carrier 14 and the receiver sheet 12 against the surface of the drum 16. The carrier 14 is driven along a path from the supply roller 20 onto a take up roller 22 by a drive mechanism 23 coupled to the take up roller 22. Microcomputer 17 also controls the drive mechanism 23. Drive mechanisms 15 and 23 each include motors which respectively advance the carrier and rotate the drum in either the clockwise or counterclockwise direction. Heaters in a print head 18 are selectively energized by a drive circuit 24 which is also controlled by the microcomputer 17.

It will be understood to those skilled in the art that the dye-carrier member 14 can be formed with a repeating series of thermally transferable dye frames. Each series includes a frame of yellow, magenta and cyan dye frames. A single series is used to print one colored image in the receiver member 12. In this way, the drum 16 must rotate the receiver sheet 12 past the print head 18 three separate times to form a full colored image. The first time a yellow image is formed, the second time a magenta dye image is formed superimposed on the yellow dye image, and the third time a cyan dye image is formed superimposed on the first two dye color images to complete the full color image.

Figure 2:
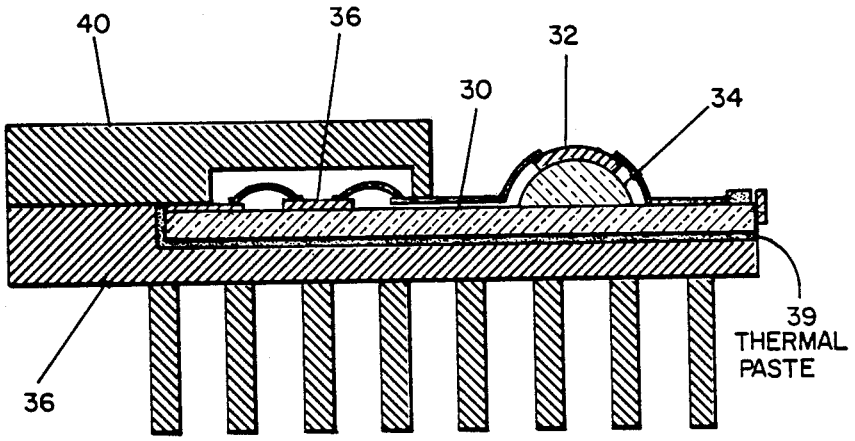
FIG. 2 is a cross-sectional view of a print head with improved heat dissipation.

Turning now to FIG. 2, where a cross-sectional view of a thermal print head shows a ceramic substrate 30 containing heaters 32 on the top surface and its bottom surface being fixedly mounted to an aluminum heat sink 36 in order to cool the ceramic substrate 30 during sustained printing. On the top surface of the substrate 30 a glaze bead 34 is formed. On the glazed bead 34 are a plurality of heaters (resistors) 32. Only one resistor is shown in the cross section. Also, mounted on the substrate 30 are driver integrated circuits 37. A combination pressure plate and cover 40 helps to retain the substrate 30 in a fixed position. Neither the ceramic substrate nor the aluminum heat sink are perfectly flat so a three point contact will result if the ceramic is directly in contact with the aluminum heat sink 36. This three point contact will provide poor thermal conductivity between the ceramic and aluminum, resulting in an excessive heat rise in the ceramic during sustained printing.

A layer of thermal paste or other material 39 is disposed between the ceramic substrate 30 and the heat sink 36. Using thermal paste decreases the thermal resistance between the ceramic and the aluminum heat sink, which indeed results in an effective reduction in printing efficiency. The additional energy required is not utilized as printing energy, but escapes as "lost" heat through the back of the ceramic into the heat sink. However, the decrease in efficiency has an unexpected benefit. Since the thermal resistance between the ceramic and the heat sink is decreased by using the improved thermal interface, the thermal "crosstalk" between adjacent heaters is decreased, because the heat can more easily flow out of the ceramic into the heat sink. In addition, the average temperature of the ceramic is decreased which allows higher contrast (or "sharper") printing. The higher average temperature of the ceramic in the print head reduces the ability of a given heater to produce a low density image pixel next to a high density image pixel. The higher average temperature and the thermal time constants of the print head tend to "compress" the dynamic printing range of a heater. Using a print head built with a lower thermal resistance interface between the ceramic and aluminum reduces the average print head and temperature and requires more energy to produce an image pixel of given density compared to print head built using polyimide tape as the interface. The difference in energy is the result of the energy "stored" in the higher average temperature of the ceramic in the head built with polyimide. A higher average print head temperature does not allow printing a low density image pixel next to a high density image pixel, in time, because the time constants associated with the head and its higher average temperature will tend to increase the density of low density image pixel. Additionally, with a lower thermal resistance because of the reduced thermal "crosstalk", adjacent heaters on the print head will be able to produce greater differences in density because there is less lateral heat transfer. Effectively, micro-contrast (or dynamic range) is increased in both direction within a print.

In addition to the micro-contrast enhancement, the warm-up phenomena seen in heads as they begin to print a picture is substantially reduced or eliminated. Since a substantially lower average temperature is maintained in the ceramic of a head built with the improved thermal interface, the "ramp" nonuniformity in transferred dye density produced by the increase in average temperature of the ceramic is eliminated.

Figure 3:
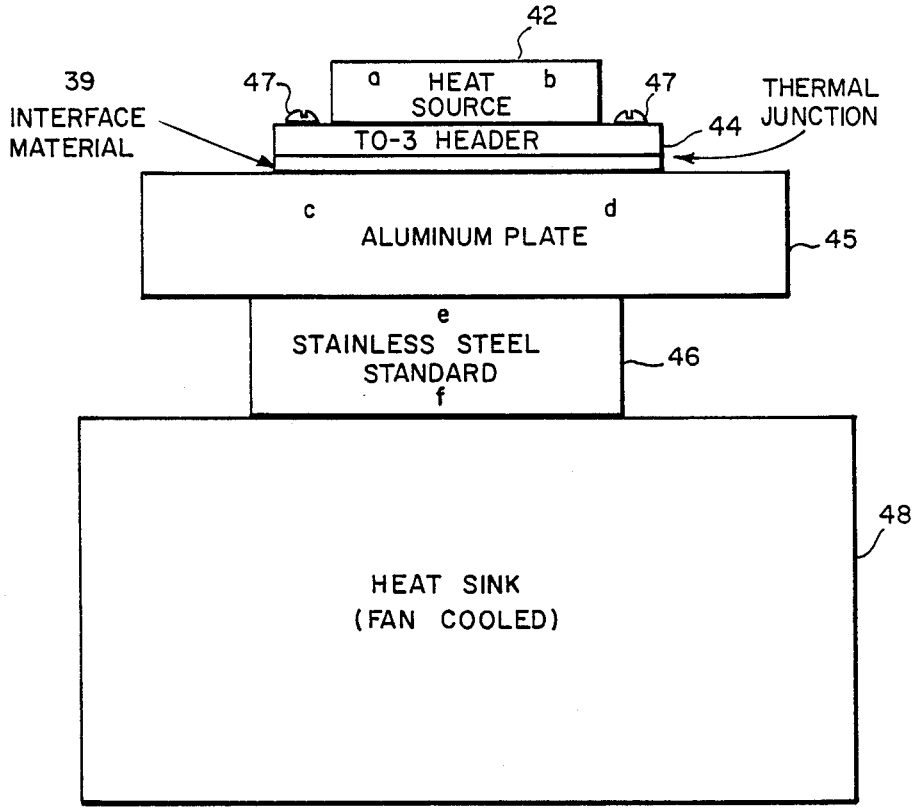
FIG. 3 is a schematic of a thermal resistance test fixture used to measure the actual thermal resistance of materials.

A polyimide tape Model Number 650S#25×25×20 manufactured by Teraoka Seisakusho was used in a print head. The tape is 25 microns in thickness and also has an adhesive layer which is 25 microns in thickness. The average thermal resistance (a number of tests) for this polyimide tape was 0.8245° C./watt. For comparison purposes Dow Corning 340 heat sink compound was also tested. This material has an average thermal resistance of 0.0665° C./watt. Images made by a print head utilizing this material had improved contrast. The purpose of the heat sink compound (paste) is to efficiently conduct heat from the surface of one material to the surface of another material. The average thermal resistance of all the materials listed in this specification were taken from data collected by using a thermal resistance test fixture shown in FIG. 3.

The fixture consists of a heat source 42, a header 44 provided by a TO-3 (standard) style transistor package, the interface material 39, an aluminum plate 45, a reference stainless steel standard 46 which has a known thermal resistance, a heat sink 48, and six 36 guage type E thermocouples which are not shown but are placed at locations a, b, c, d, e and f, respectively. The material 39 whose thermal resistance is to be measured is placed between the header 44 and an aluminum plate 45 and placed under a pressure caused by tightening mounting screws 47 at 6 inch/pounds torque. The screws 47 are fastened in the plate 45. By measuring the difference in temperature across the standard 46 of known thermal resistance the thermal current "Q" is found. Then by measuring the temperature difference across the junction, and dividing this value by Q the thermal resistance for the material is found.

The invention has been described in detail with particular reference to preferred embodiments thereof, but it will be understood that variations and modifications can be effected within the spirit and scope of the invention.

I claim:

1. A print head for a continuous tone thermal printer comprising:

(a) an aluminum heat sink;

(b) a ceramic substrate having first and second surfaces;

(c) heaters mounted on the substrate first surface;

(d) a thermal paste providing a thermal interface between the heat sink and the second surface of the ceramic substrate; and (e) the thermal paste having a thermal resistance, of less than about 0.6° C./Watt which will cause the contrast of a thermal print produced by this head to be improved by reducing both average print head temperature and lateral heat transfer between adjacent heaters.

* * * * *

US004837586B1

REEXAMINATION CERTIFICATE (1733rd)

United States Patent [19]

Brownstein

[11] B1 4,837,586

[45] Certificate Issued Jun. 30, 1992

[54] IMAGE CONTRAST BY THERMAL PRINTERS

[75] Inventor: Scott A. Brownstein, Rochester, N.Y.

[73] Assignee: Eastman Kodak Company, Rochester, N.Y.

Reexamination Request:
No. 90/002,212, Nov. 27, 1990

Reexamination Certificate for:

| | |
|---|---|
| Patent No.: | **4,837,586** |
| Issued: | **Jun. 6, 1989** |
| Appl. No.: | **149,253** |
| Filed: | **Jan. 28, 1988** |

[51] Int. Cl.[5] ..... B41J 3/20

[52] U.S. Cl. ..... 346/76 PH

[56] References Cited

FOREIGN PATENT DOCUMENTS 61-130060 6/1986 Japan .
61-140843 9/1986 Japan .

OTHER PUBLICATIONS

Toray Silicone Catalog dated May, 1986.

*Primary Examiner*—Teresa J. Walberg

[57] ABSTRACT

A thermal paste or other thermal resistance material is placed between the ceramic substrate and heat sink of a thermal print head. By selecting the thermal resistance of the material to be sufficiently low, print contrast is improved.

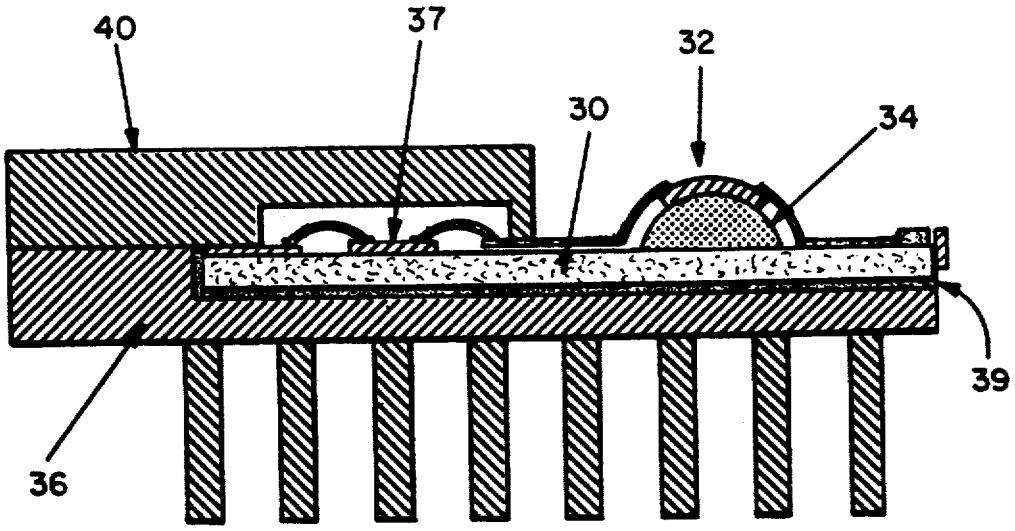

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claim 1 is cancelled.

* * * * *